US005207156A

United States Patent [19]

Helling

[11] Patent Number: 5,207,156

[45] Date of Patent: May 4, 1993

[54] PROCESS AND APPARATUS FOR PRINTING ON ARTICLES

[75] Inventor: Ralf Helling, Melle, Fed. Rep. of Germany

[73] Assignee: Werner Kammann Maschinenfabrik GmbH, Bunde, Fed. Rep. of Germany

[21] Appl. No.: 605,634

[22] Filed: Oct. 30, 1990

[30] Foreign Application Priority Data

Oct. 31, 1989 [DE] Fed. Rep. of Germany ..... 3936157

[51] Int. Cl.[5] ..... B41F 17/18

[52] U.S. Cl. ..... 101/38.1; 101/40; 101/126

[58] Field of Search ..... 101/38.1, 35, 39, 40, 101/126, 123, 124

[56] References Cited

U.S. PATENT DOCUMENTS

| | | | |
|---|---|---|---|
| 4,109,573 | 8/1978 | Strauch et al. | 101/38.1 |
| 4,164,279 | 8/1979 | Dubuit | 101/38.1 |
| 4,254,706 | 3/1981 | Lala | 101/38.1 |
| 4,352,326 | 10/1982 | Kammann | 101/39 |
| 4,398,627 | 8/1983 | Saccani | 101/38.1 |
| 4,502,380 | 3/1985 | Meador | 101/38.1 |
| 4,567,822 | 2/1986 | Heidenreich et al. | 101/38.1 |
| 4,592,277 | 6/1986 | Dennesen et al. | 101/38.1 |
| 4,781,112 | 11/1988 | Cohan | 101/38.1 |
| 4,787,310 | 11/1988 | Tiemann | 101/40 |
| 4,798,135 | 1/1989 | Meredith | 101/40 |

*Primary Examiner*—Edgar S. Burr
*Assistant Examiner*—John S. Hilten
*Attorney, Agent, or Firm*—Seidel, Gonda, Lavorgna & Monaco

[57] ABSTRACT

In a process and apparatus for printing on articles which are at least in part of non-round cross-sectional shape, by means of screen printing, the article is received by a holding arrangement for supporting it during the printing operation, when the holding arrangement is in an intermediate position between first and second limit positions defining a range of pivotal movement of the holding arrangement, during which the printing is applied to the article. The movements of the article during the printing operation are for the purposes of that operation and not for transportation purposes, the article being transported by at least one transportation arrangement provided specifically therefor.

20 Claims, 9 Drawing Sheets

VII
VII
86
88
87
60
58
56
38
64
96
54
52
68
71
72
76
73
77
74
78
79
82
80

38
26
64
52
54
73
71
70
68
95
89
88
74
20
83
93
86
80
82
79
78
85
84

PROCESS AND APPARATUS FOR PRINTING ON ARTICLES

BACKGROUND OF THE INVENTION

There is often a need to apply printing to articles having at least one portion which is of non-round cross-sectional shape, for example a bottle, the body of which may include at least a portion of elliptical cross-section which may or may not be symmetrical. Such printing may typically be applied by means of a screen printing process using an apparatus with at least one holding arrangement for holding the respective article to which printing is to be applied, the holding arrangement being disposed pivotably about an axis which is not at the center point of the article. The apparatus used includes a screen printing stencil and a squeegee, which can also be referred to as a doctor, which is displaceable relative to the screen printing stencil.

In a screen printing process which is carried out using the above-indicated apparatus, as disclosed in German laid-open application (DE-OS) No 25 30 360, the holding arrangement is carried by a chain which is flexible in a plane which extends parallel to the direction of movement of the article during the printing operation and normal to the screen printing stencil. Associated with the chain in the region of the screen printing stencil is a guide portion in the form of a cam member whose surface which co-operates with the chain is adapted to the configuration of the surfaces of the article to which printing is to be applied. The holding arrangement which is carried by the chain is reciprocated between two limit positions. In one limit position, the article to which the printing is to be applied is received by the holding arrangement and the article is then passes through the printing station while being carried by the holding arrangement, whereupon in the outer limit position of the reciprocating movement the object with printing thereon is removed from the holding arrangement and then the latter is moved back into the first limit position again, to receive the next following article. That means that the position at which the article with printing applied thereto is removed from the holding arrangement does not coincide with the position at which the fresh article to which printing is then to be applied is introduced into the holding arrangement. On the contrary, between those two positions there is a distance which corresponds to the transportation step which the holding arrangement is required to perform between the position for receiving an object and the position for releasing same.

Screen printing apparatuses which are used for example for printing on hollow articles such as bottles and other containers are generally provided with or combined with a transportation arrangement for the articles. In such an assembly, the articles are moved stepwise from a feed position to which they have been moved for example by a conveyor device disposed upstream of the assembly, into a receiving position in which they are received by the holding arrangement. The holding arrangement moves the article through the processing station, for example a printing station, and then passes into a discharge position in which it releases the article with printing applied thereto, for the article possibly to be carried away from that location by a discharge conveyor assembly.

It is also possible and in every way conventional practice for the screen printing apparatus to include a plurality of processing stations through which the article is passed with a stepwise movement in order to be subjected to successive processing operations. The stations involved may include for example a station for removing dust, a further station for applying a flame treatment to the article, one or more stations for applying printing to the article and stations in which the printing ink on the article is dried.

The length of the transportation stepping movement between the individual stations will normally be established in dependence on the greatest length of the printed image to be applied to the article and thus possibly also the maximum size of the article to which printing is to be applied in the respective apparatus. The result of those considerations is that the transportation step is utilised in its entirety for the printing operation only in those situations in which articles are to be provided with a printed image thereon, the extent of which requires during the printing operation a movement which corresponds to the length of the actual transportation stepping movement. In all cases in which therefore the article is to be provided with printing which is of a shorter extent in the printing direction, the article is transported by a distance which is greater than that which is technically required to perform the printing operation, with the result that the through-put of the apparatus and therefor the level of productivity thereof is lower than would be possible from the printing procedure point of view. That disadvantage is also encountered in other known screen printing apparatuses which are used for applying printing to articles which are of non-round cross-section and in particular substantially elliptical articles. Added to that is the fact that the length of the transportation step when moving the article without simultaneously applying a treatment thereto is also fixed by the transportation step required for the printing operation when printing on the largest possible article capable of being printed upon in the screen printing apparatus, which transportation step is normally greater than that which is required for the actual transportation operation. That is also due to the fact that the stepwise transportation movement of the articles from one station to another with the usual transportation arrangements which perform a reciprocating movement presupposes that the distances between the individual stations, in the region of the transportation arrangement, are equal.

SUMMARY OF THE INVENTION

An object of the present invention is to provide a screen printing process for printing on articles having at least one portion of non-round cross-section, which avoids the above-discussed disadvantages.

Another object of the present invention is to provide a screen printing process for printing on articles of non-round cross-section, in which movements of the article to be printed upon, which are required for carrying out a printing operation in a printing station, can be effected independently of transportation movements.

Still another object of the present invention is to provide a screen printing process for printing on articles with at least one portion of non-round cross-sectional shape, involving a transportation step for the article, the length of which step can be selected without needing to take account of the extent of the movement to be performed by the article during the printing operation.

Still a further object of the present invention is to provide a screen printing process for printing on articles of non-round cross-section wherein the length of a respective transportation step of the article in the printing process can be kept constant upon a change in the article to be printed upon even when the movement of the article during the printing operation is altered when changing from kind of article to another.

Yet a further object of the present invention is to provide a screen printing apparatus for printing on articles with at least a portion of non-round cross-section, which affords enhanced versatility in terms of the operating and transportation movements required.

In accordance with the principles of the present invention, in a first aspect, these and other objects are achieved by a screen printing process for printing on articles having at least one portion of non-round cross-section, using an apparatus comprising at least one holding means for the article, which holding means is arranged pivotably about an axis which is not at the center point of the article, with a screen printing stencil and a squeegee which is displaceable relative thereto. In the screen printing process the holding means for the article to be printed upon is moved into a first position and said article is also moved into a position corresponding to the position of the holding means such that the longer axis of the cross-sectional configuration of the portion of the article to be printed upon extends substantially horizontally. The article is picked up in that position by the holding means whereupon the holding means with the article held thereby perform a first pivotal movement whereby the holding means with article are moved into a initial position in which a second pivotal movement begins, in the opposite direction to the first pivotal movement. At least during a part of said second pivotal movement the required printing is applied to the article and, after the holding means and the article reach their final position at the end of the second pivotal movement, they perform a third pivotal movement in the direction of the first pivotal movement such that at the end of the third pivotal movement the holding means and the article held thereby are again in the first position in which the article with printing thereon is then removed from the holding means.

In a second aspect of the invention the foregoing and other objects are achieved by a screen printing apparatus for printing on articles with at least a portion of non-round cross-section, including a holding means for holding the article, being adapted to be pivoted with a reciprocating movement about an axis which is not at the center point of the article, a screen printing stencil and a squeegee which is displaceable with respect to the stencil. The holding means is displaceable between a first position, between limit positions of its range of pivotal movement, for receiving an article to be printed upon, the article being so positioned in the holding means that the longer axis of the non-round cross-sectional configuration of the article extends substantially horizontally in said first position of the holding means. After picking up the article, the holding means is pivoted by a first pivotal movement into a starting position corresponding to a first limit position of its said range of pivotal movement and from which it begins a second pivotal movement in the opposite direction to the first pivotal movement. At least during a part of the second pivotal movement, means are operable to apply printing to the article and, after termination of its second pivotal movement, the holding means is operated to perform a third pivotal movement in the direction of the first pivotal movement, in the course of the third pivotal movement the holding means being pivoted into its said first position, for removal of the printed article therefrom.

As will be seen in greater detail from the description hereinafter of a preferred embodiment, the operation procedure in accordance with the teachings of the present invention provides that the article is moved by a transportation assembly into a specific position which corresponds to the receiving position adopted by the holding means. In that position the holding means receives the article and is then returned to the same position, after the printing operation has been performed, to return the article to the transportation assembly. That affords the advantage that the stroke movements to be performed by the transportation assembly, which correspond to the individual transportation stepping movements of the articles, can be determined exclusively from the points of view of transportation procedure. There is no need for the transportation stroke movement of the transportation assembly to be such that account has to be taken of movements to be performed by the article during the actual printing operation. On the other hand, the holding means which carries the article in the processing station, for example a printing station, can be moved in such a way as to have regard exclusively to the requirements of the printing procedure, as the holding means does not involve any transportation function. Another advantage is that transportation of the article on the one hand and presentation thereof for the printing operation on the other hand are also performed independently of each other. When applying printing to an article of non-round cross-section, for example an article of elliptical cross-section, it is necessary for the article, at the beginning of the printing operation, to be moved into a position in which generally the longer axis of the elliptical cross-sectional configuration extends at an acute angle relative to the plane of the screen printing stencil. A similar consideration applies in regard to the position adopted by the article at the end of the printing operation. Presentation of the article prior to the commencement of the printing operation is effected in the case of the process in accordance with the invention by the holding means being pivoted from the position in which it receives the article, into the initial position for the movement during which printing is applied to the article. With the position at which the holding means receives the article being disposed centrally between the initial position and the terminal position of the printing stroke movement, that means that, for presentation of the article for printing operation, the holding means is pivoted approximately by half the distance through which it is pivoted during the movement during which the printing operation is carried out. In a similar fashion, after the termination of the printing operation, the holding means is pivoted from the terminal position approximately through half the above-indicated distance into the intermediate position at which the article with printing thereon is released. In that intermediate position which corresponds to the first position occupied by the holding means and the article at the beginning and at the end of the sequence of movements involved in the screen printing process of the invention, the chord in the cross-section of the region of the article to which the printing is to be applied extends substantially parallel to the screen printing stencil. In the case of the article in which the portion which is to receive the printing is of substantially elliptical cross-sectional configuration, the above-mentioned chord which extends substantially parallel to the screen printing stencil will generally be the longer axis of the elliptical configuration, although that is not absolutely necessary in all cases.

If the article is held during the treatment operation at two spaced-apart regions thereof, as is the generally conventional practice, the holding means can be of a two-part configuration, for example in such a way that one part of the holding means supports the article at the bottom thereof while the other part of the holding means supports the article at its opposite end, for example at the neck region when the article is a bottle.

The holding means for carrying the article is mounted pivotably on the frame structure of the apparatus in such a way that the plane in which the pivotal movement thereof occurs extends substantially normal to the screen printing stencil and in the direction in which the latter is moved during the printing operation. As there is no direct relationship between the movement of the article during the printing operation on the one hand and the transportation stroke movement on the other hand, the printing speed can be selected exclusively from the points of view which are relevant to the printing procedure involved.

Further objects, features and advantages of the invention will be apparent from the following description of a preferred embodiment.

DESCRIPTION OF THE PREFERRED EMBODIMENT

Figure 1:
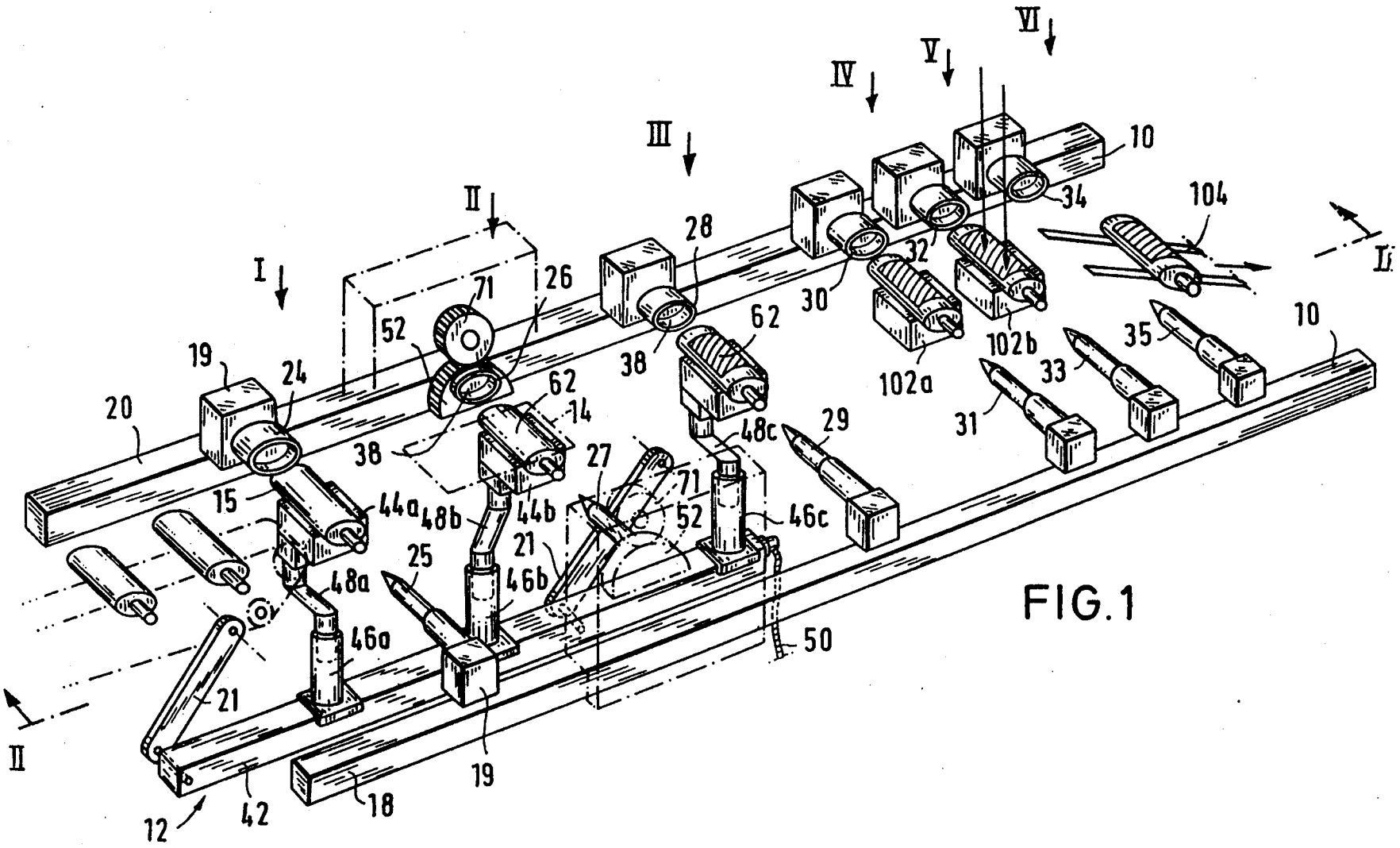
FIG. 1 is a perspective view of a screen printing machine.

Referring firstly to the general view of the screen printing apparatus shown in FIG. 1, it will be seen therefrom that the apparatus comprises six stations respectively indicated at I, II, III, IV, V and VI, in which the respective articles are each carried by an article carrier 10, and a transportation arrangement 12. The station indicated at II is in the form of a printing station and is thus equipped with a screen printing stencil 14 and a squeegee or doctor 16. The stencil 14 and the squeegee 16 co-operate in the manner which is generally known and conventional practice in relation to a screen printing process. The article carrier 10 comprises two horizontal and mutually parallel rail members 18, 20 which are arranged at a horizontal spacing from each other. The articles to which printing is to be applied are held by the two rail members 18 and 20 which are displaceable transversely relative to each other in the direction indicated by the arrows 22 and 23 in FIG. 3, when the articles are disposed in a respective one of the stations I through VI. In the embodiment illustrated in the drawings, the articles involved are bottles, the body of which has a symmetrical elliptical cross-section. It will be noted however that the cross-section does not necessarily have to be symmetrical. It is sufficient for the surface of the respective article to which printing is to be applied to be of such a shape that it can be appropriately rolled against the screen printing stencil 14, while being of non-round cross-sectional configuration.

Holding members 24, 25; 26, 27; 28, 29; 30, 31; 32, 33; 34, 35; are mounted in pairs on the two rail members 18 and 20 of the article carrier 10 in the respective stations I through VI, in such a way that the holding members of each pair are disposed in mutually opposite relationship. The holding members are adapted to the configuration of the article to be held thereby, in the usual manner. In other words, for dealing with an article in the form of a bottle, the holding members 24, 26, 28, 30, 32 and 34 which are designed to carry the bottom end of the bottle are each provided with a recess indicated at 38, in the form of a seat into which the bottom region of the article or bottle fits. On the other hand the holding members 25, 27, 29, 31, 33 and 35 are of a mandrel-like configuration so that they can engage into the neck or mouth opening of the respective article to be carried thereby. In the stations I and III through VI the holding members are mounted to the rail members 18 and 20 by way of interposed brackets 19. The way in which the mounting members 26 and 27 are mounted in position in the other station, being the printing station II, will be described hereinafter.

The transportation arrangement 12 which is arranged essentially below the article carrier 10 comprising the two rail members 18 and 20 serves to provide for stepwise transportation of the articles from station I to the printing station II and from the latter to stations III and IV. For that purpose the transportation arrangement 12 is mounted to the frame structure of the apparatus by way of pivotal arms 21 in such a way that it can be pivoted with a reciprocating movement in the direction indicated by the arrows 40 in FIG. 2 and in the opposite direction thereto. It essentially comprises a bearer member 42 to which first, second and third transportation holders 44*a*, 44*b* and 44*c* are releasably mounted. In the illustrated embodiment, the releasable mounting of the holders 44*a*, 44*b* and 44*c* is effected by way of tubular intermediate members 46*a*, 46*b* and 46*c* which are suitable secured to the bearer member 42. Each of the intermediate members 46*a*, 46*b* and 46*c* can receive a respective projection 48*a*, 48*b*, 48*c* of the respective holder 44*a*, 44*b*, 44*c*. Each of the transportation holders 44*a*, 44*b*, 44*c* is adapted in respect of its upwardly facing boundary surface to the configuration of the article to be processed in the apparatus. In order to ensure that the article remains in its correct position on the respective transportation holder during the transportation movement, the transportation holder is provided at its upwardly facing surface on which the article is supported with openings which can be connected to a vacuum or reduced pressure source so that a suction effect is applied to the article to hold it against the transportation holder, in the correct position thereon. The connection of the transportation holders to the vacuum source is by way of a connecting conduit indicated at 50 in FIG. 1, the bearer member 42, the tubular intermediate members 46*a–c* and the projections 48*a–c* which fit into the intermediate members and which are of a hollow configuration, thereby forming suction conduits.

The holding members 26, 27 which hold the respective article disposed in the printing station II are of generally the same design configuration as the corresponding holding members in the other stations. However they are mounted in such a way as to permit movement of the holding members 26, 27 and therewith the article to which printing is to be applied, during the printing operation. That movement is adapted to the configuration of the respective surface to be printed upon, more specifically the curvature thereof.

Reference will be made at this stage to FIGS. 6 through 9 showing details of the manner of mounting of the holding members 26, 27 and the configuration thereof, together with the co-operation of the components which provide for the movement of the holding members. For the sake of simplicity, the following description with reference to FIGS. 6 through 9 will describe the arrangement in connection with the holding member 26 which receives the bottom portion of an article to be printed upon, in the form of a bottle. However the holding member 27 which, when the article is a bottle, extends into the neck of the bottle to hold it in position and is therefore of a somewhat different configuration from the holding member 26 is arranged in the same manner and is provided with the same drive means.

As the holding member 26 is used for printing on an article in the form of a bottle with a body of elliptical cross-sectional configuration, as indicated at 15 for example in FIG. 1, the holding member 26 is provided with the above-mentioned seat 38 into which the bottom portion of the bottle fits and which is therefore of a corresponding elliptical contour. For the sake of enhanced clarity of the drawings in FIGS. 6 through 9, it is essentially only the elliptical contour of the seat 38 in the holding member 26 that is shown, that contour being at least substantially identical to the contour of the portion of the body of the bottle 15, to which printing is to be applied.

The mounting member 26 is carried by a toothed segment 52 which is mounted rotatably on a mounting member 56 by way of a shaft 54. The mounting member 56 is mounted on a vertical rail 58 in such a way as to be adjustable in respect of height. More specifically the arrangement is such that the rail 58 is provided with an opening in the form of a slot, which extends parallel to its longitudinal direction and through which engages a clamping screw 60 which can be screwed into a receiving screwthreaded bore in the mounting member 56.

The radius of the toothed segment 52 is the same as the radius of the surface 62 of the article to which a printed image is to be applied. In that connection the arrangement is such that the contours of the seat 38 in the holding member 26, in the region corresponding to the region of the bottle which is to be provided with the printed image, is aligned with the pitch circle of the toothed segment 52. That is made possible by the above-mentioned fact that the radius of the tooth configuration or, more precisely, the pitch circle of the toothed segment 52 on the one hand and the radius of the surface 62 of the body of the bottle to which printing is to be applied on the other hand are the same.

Figure 6:
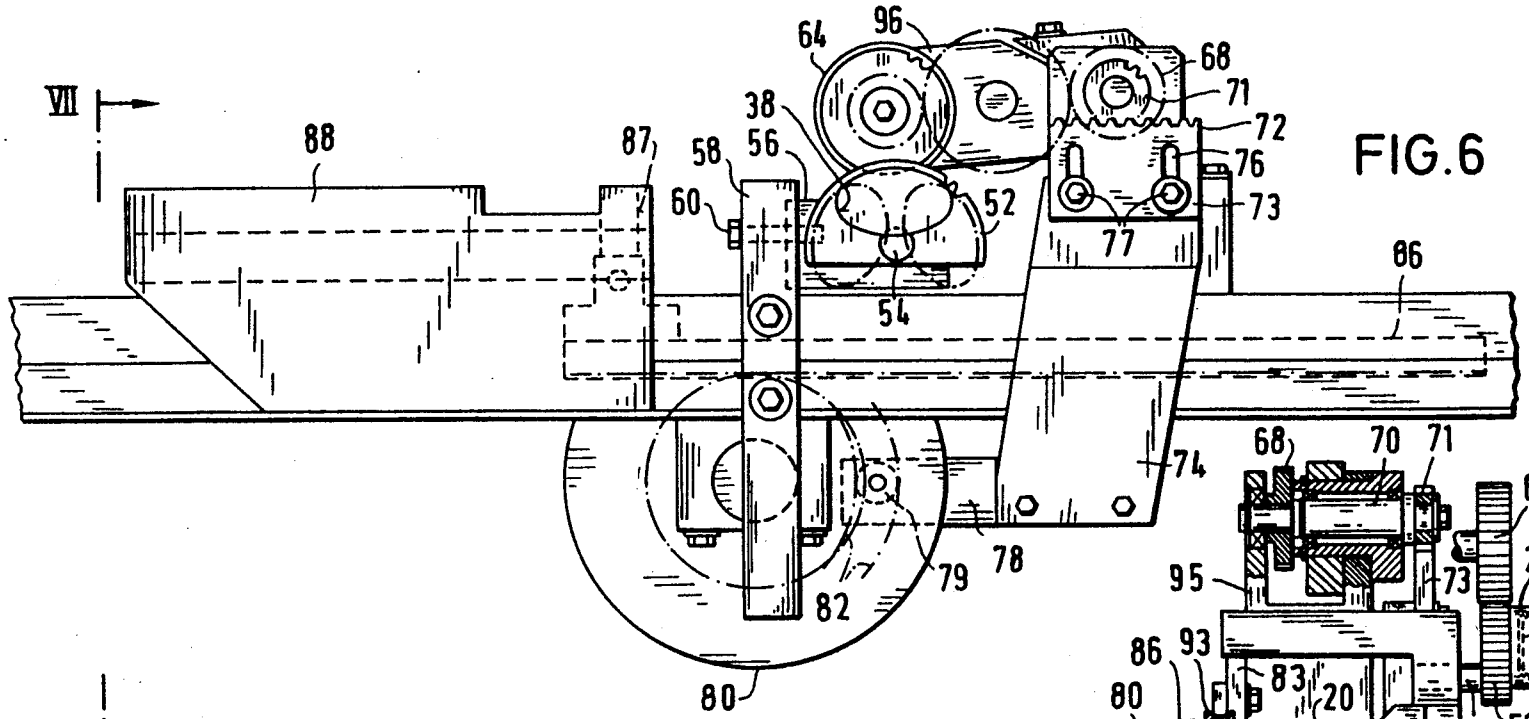
FIG. 6 is a side view of a holding member in a printing station for carrying the articles, including the drive elements required for producing the movement thereof.
Figure 7:
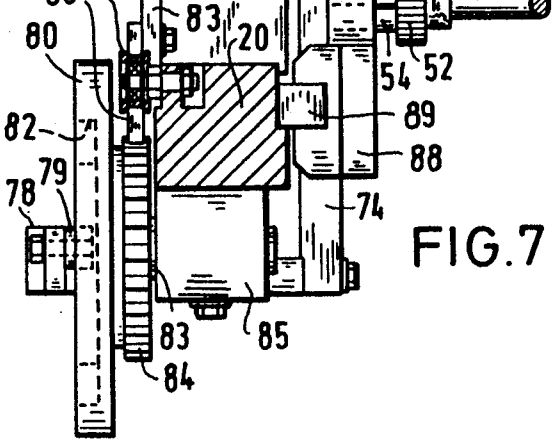
FIG. 7 is a front view of the FIG. 6 structure viewing in the direction indicated by the arrows VII—VII in FIG. 6.
Figure 8:
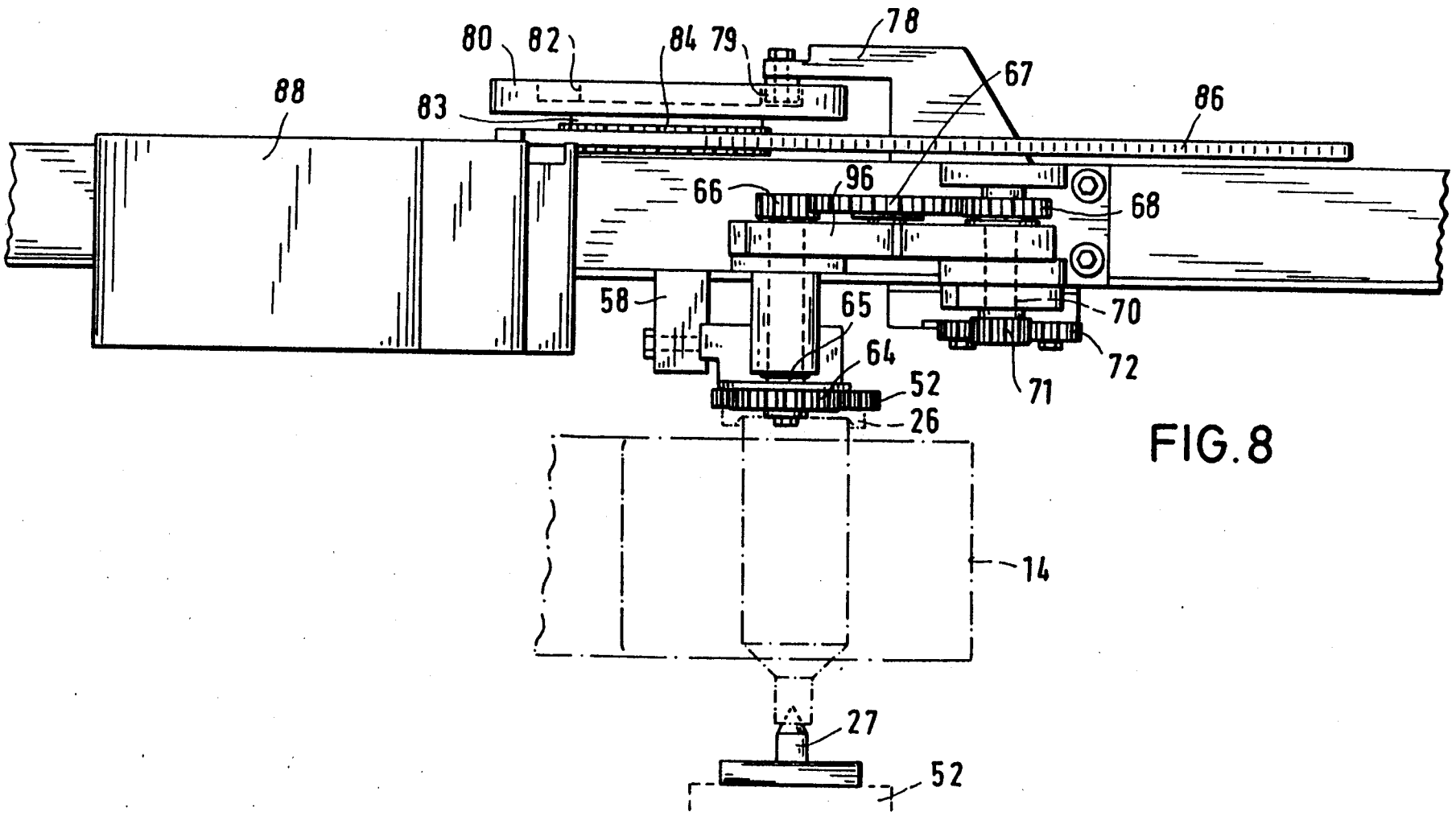
FIG. 8 is a plan view of the FIG. 6 structure.

The toothed segment 52 meshes with a gear 64 fixedly connected to a shaft 65 which carries a pinion indicated at 66 in FIG. 8, fixedly mounted on the other end of the shaft 65. The pinion 66 is driven by a pinion 68, by way of a further interposed gear 67. The pinion 68 which can be seen in FIGS. 6 through 9 is fixedly connected to a shaft 70 which at its other end fixedly carries a pinion 71. The pinion 71 meshes with a toothed rack 72 which can be clearly seen in for example FIG. 6 and which is carried by a toothed rack slider 74 which performs a horizontal reciprocating movement. The toothed rack 72 has a projection portion 73 provided with slots indicated at 76 in FIG. 6. Here too the arrangement includes clamping screws 77 which engage into screwthreaded bores in the slider 74 so that the projection portion 73 and therewith the rack 72 can be mounted to the slider 74 at a variety of different positions, in respect of height.

The shaft 70 is carried by a mounting block indicated at 95 in FIG. 7 which is carried on the rail member 20. An arm which is shown at 96 in FIGS. 6 and 8 is also mounted on the mounting block 95 and is pivotable about the shaft 70 and can be secured in its respective position. The arm 96 carries the gear 67 and the shaft 65 with the gears 64 and 66. The respective position of the arm 96 results from the diameter and the position of the segment 52 and the diameter of the gear 64 meshing with the segment 52. They are once again determined by the shape and the dimensions of the article to which printing is to be applied.

Looking now again at FIG. 6, an arm 78 which is fixedly mounted to the slider 74 is provided at its free end, towards the left in FIG. 6, with a cam follower roller 79 engaging into a cam 82 mounted on a rotatably supported cam plate or disc 80. The cam plate or disc 80 is carried by a shaft 83 which can be seen for example in FIG. 7 and on which a gear 84 is also fixedly mounted. The shaft 83 is carried by a mounting block 85 which is fixedly mounted to the rail member 20. The gear 84 and therewith the cam plate or disc 80 is driven by way of a rack 86 carried by a horizontally reciprocatable drive slider indicated at 88 in both FIGS. 6 and 8. The drive slider 88 is driven by the main drive assembly of the screen printing apparatus and the reciprocating movement for the screen printing stencil 14 is also derived from the drive slider 88. The drive slider 88 is guided on a guide indicated at 89 in FIG. 7, the guide 89 being mounted to the rail member 20 at the right-hand side thereof in FIG. 7. The drive slider 88 engages over the rail 20 so that the rack 86 is carried by a projection portion 87 of the slider 88 at the side thereof which is remote from the guide 89. Mounted on the rail member 20 is a roller indicated at 93 in FIG. 7 which guides the rack 86.

Figure 9A:
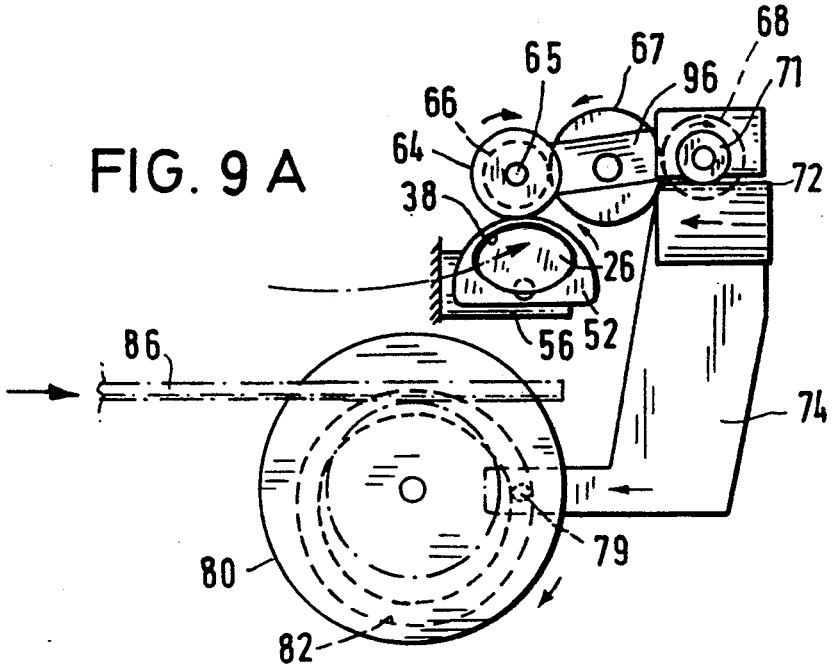
FIGS. 9A–D are views corresponding to that shown in FIG. 6, in highly diagrammatic form and in four successive positions, of the holding members including the associated drive elements.
Figure 9B:
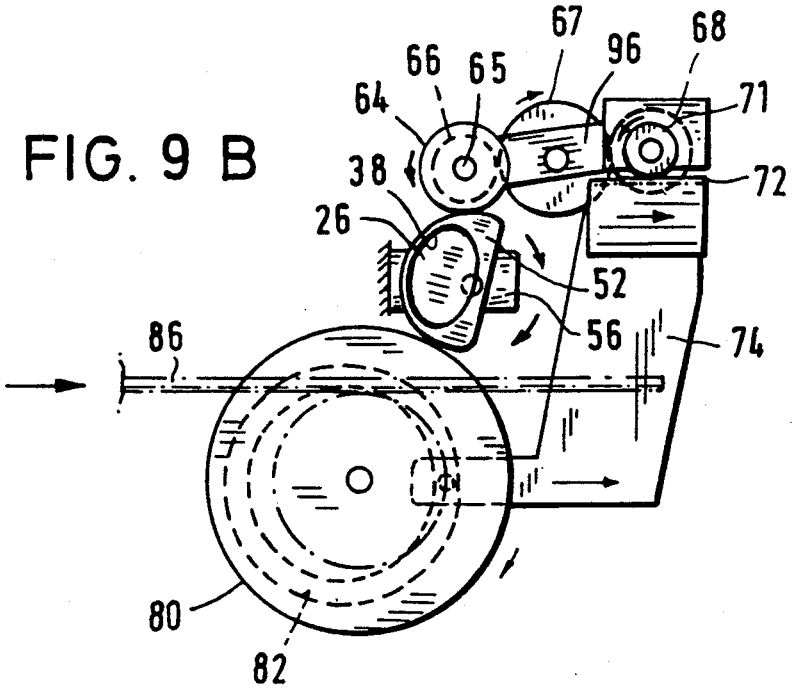
Figure 9C:
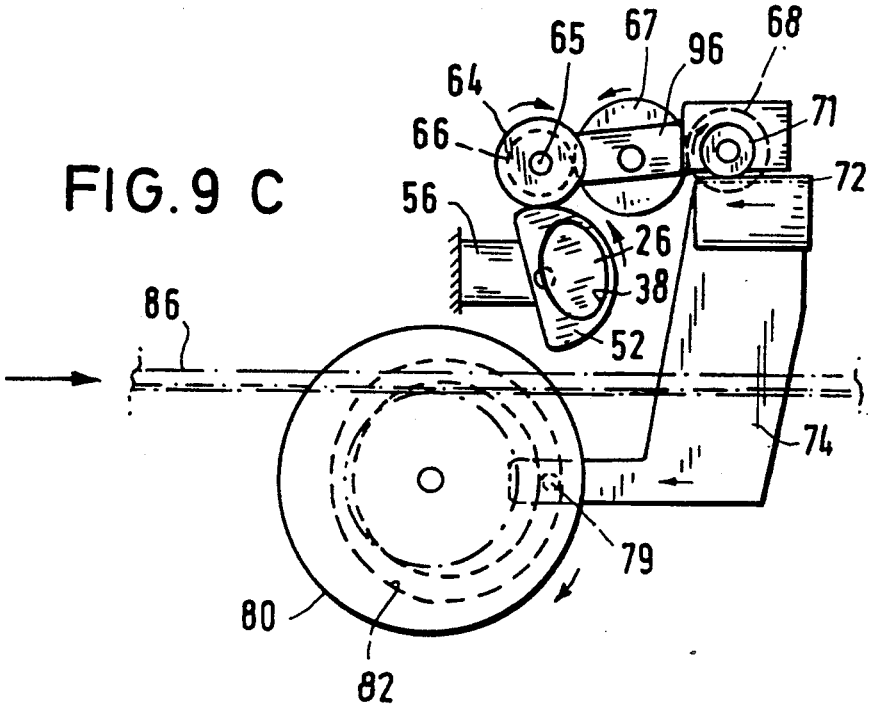
Figure 9D:
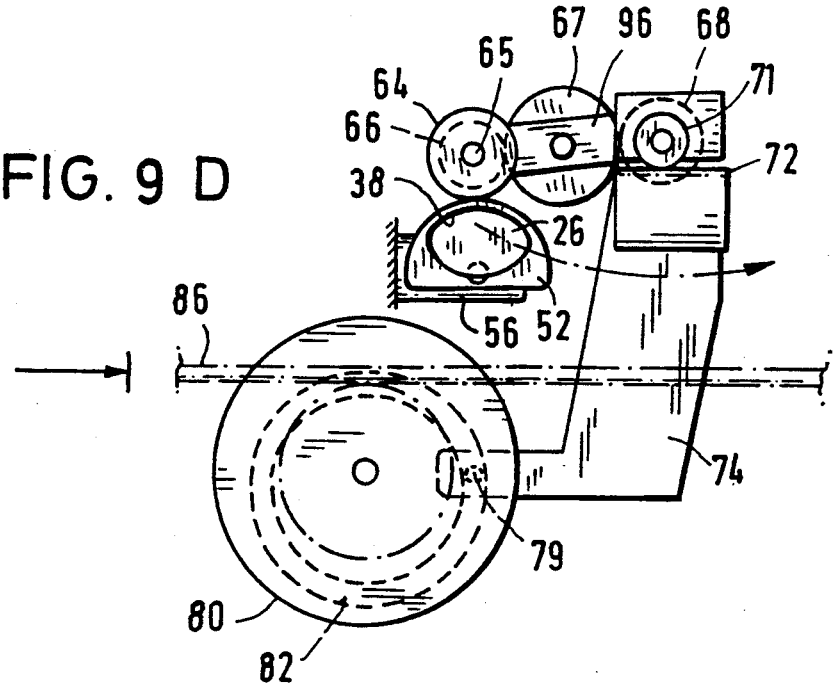

The arrangement and configuration of the cam 82 in the cam disc or plate 80 and the size of the mutually co-operating pinions and gears 71, 68, 67, 66 and 64 and the transmission ratio resulting therefrom are so selected that during a complete revolution of the cam disc or plate 80, the toothed segment 52 and therewith the holding member 26, starting from the first position shown in FIG. 9A which is disposed centrally between first and second limit positions of the holding member 26, are firstly turned through half of the total travel distance between the above-mentioned limit positions into an initial position for the movement required during the printing operation of the toothed segment 52 and therewith the holding member 26. That is the position shown in FIG. 9B. The movement from the middle position into the initial position for the movement required during the printing operation corresponds to rather less than 90° of a complete revolution of the cam disc 80. The subsequent movement of the toothed segment 52 with the holding member 26 from the first limit position corresponding to the initial position into the second limit position as shown in FIG. 9C corresponds to a rotary movement of the cam disc 80 through about 180°. In the last phase, the toothed segment 52 with the holding member 26 carried thereby is then pivoted back into the central position as shown in FIG. 9D, during about the last 90° of the rotary movement of the cam disc or plate 80. FIG. 6 shows the central position of the holding member 26 in solid lines while the first and second limit positions are shown in broken lines therein.

During the above-described movements of the toothed segment 52 with holding member 26, the screen printing stencil 14 performs a stroke movement, in the course of which printing is applied to the article in question. At least during a part of its movement from the first limit position to the second limit position, the article is in contact with the screen printing stencil for producing printing on the article. The stroke movement of the screen printing stencil and the pivotal movement of the article thus take place synchronously.

Figure 3:
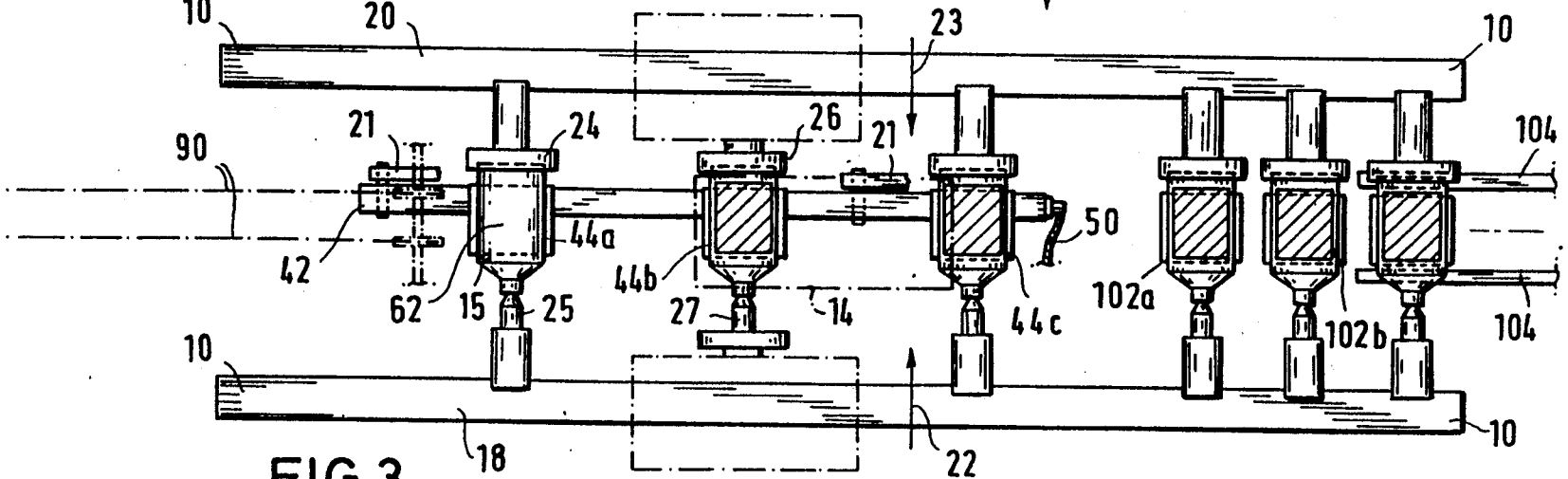
FIG. 3 is a plan view of the FIG. 1 machine, but with the holding members for the articles to be printed upon being in a different position from that shown in FIG. 1.

It is important to notice at this juncture that it is in the central position of the holding members 26, 27 as shown in FIGS. 9A and 9D, that the article to which printing is to be applied is received by the holding members, by suitable displacement of the two rail members 18 and 20 towards each other in the directions indicated by the arrows 22 and 23 in FIG. 3. In the same manner, after termination of the printing operation, the article which now bears printing is released again in that central position by virtue of the two rail members 18, 20 being suitable moved apart in the opposite directions to the directions indicated by the arrows 22 and 23, so that the position in which the article is received by the holding members and the discharge position in which the article is released from the holding members are constituted by the same position in the process and apparatus in accordance with the principles of the present invention.

Figure 2:
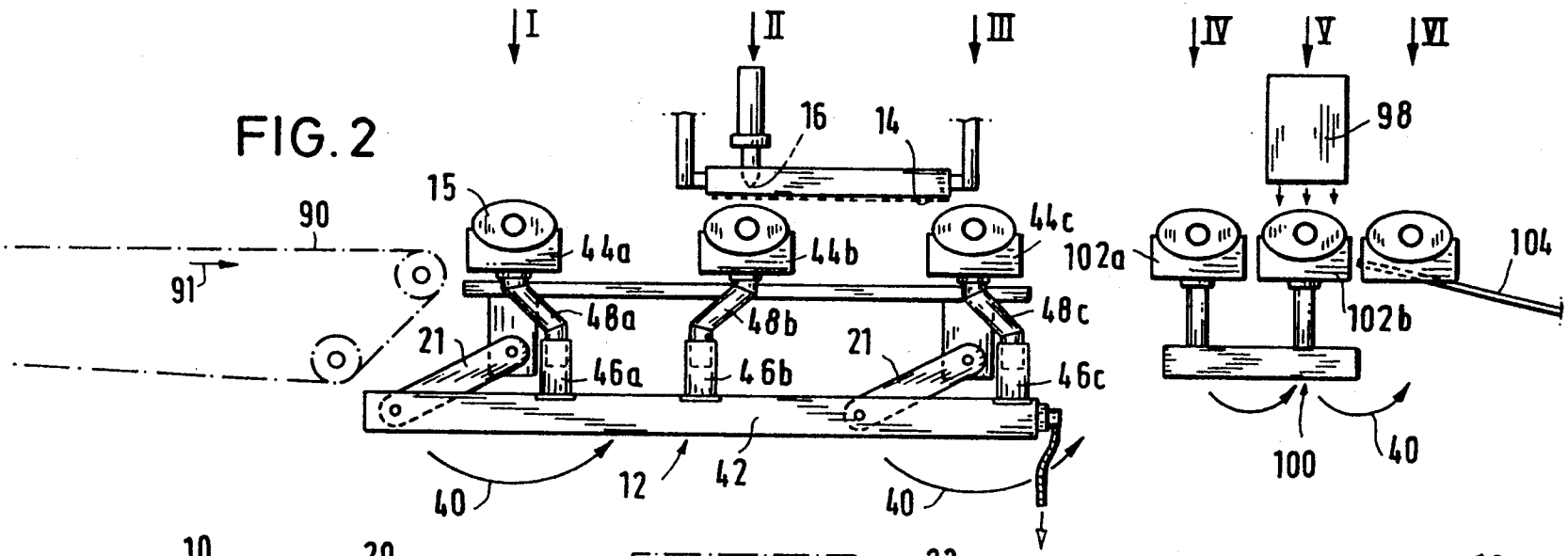
FIG. 2 is a side view of the FIG. 1 machine in section taken along line II—II in FIG. 1.

The illustrated apparatus operates in the following manner:

An article, illustrated in the form of a bottle 15, which has been transported by a conveyor belt indicated at 90 in FIG. 9 in the direction indicated by the arrow 91 in FIG. 2 to the station I is there received by the holding members 24, 25. That is effected in the above-described manner by the two rail members 18 and 20 moving towards each other in the directions indicated by the arrows 22 and 23. In the course of that movement the distance between the two holding members 24 and 25 is reduced to such an extent that the article 15 disposed at station I is engaged by the holding members 24 and 25. A similar situation applies in regard to the other holding members 26, 27; 28, 29; 30, 31; 32, 33; 34, 35 which in the same manner engage respective articles disposed in each of the other stations II through VI. For transfer of the bottle from the conveyor belt 90 to the holding members 24 and 25, it is also possible to use additional means (not shown) of known design configuration.

It is in station II that the operation of applying printing to the article disposed in that station is carried out. At the same time suitable treatments can also be performed in the other stations. Thus it is possible for example if necessary to apply a flame treatment in station I to the bottle 15 if it comprises a thermoplastic material in order to provide for adequate adhesion of the printing ink to the surface of the bottle 15. Stations IV through VI may be used for drying of the printing ink which has been previously applied in the station II, that operation being primarily effected in station V at which there is an UV-radiating means 98 (see FIG. 2) which also applies radiation to the two adjacent stations IV and VI, even if to a lesser degree.

Associated with the stations IV, V and VI is a particular transportation arrangement indicated at 100 in FIG. 2, which is provided with first and second transportation holders **102*a* and 102*b* and which moreover is arranged for reciprocating pivotal movement in the same way as the conveyor arrangement 12. The only difference between the transportation arrangement 100 and the conveyor arrangement 12 is that the two transportation holders 102*a*, 102*b* are arranged at a smaller spacing from each other than the corresponding holders 44*a*–44*c* in the conveyor arrangement 12**. That is to be attributed to the fact that the stations IV, V and VI are at smaller spacings from each other than stations I through III. That smaller pacing is possible for the reason that those stations do not have associated therewith any devices which require a given minimum spacing therebetween. The latter aspect is the case for example with the devices used in the printing station II in which at any event the screen printing stencil requires a given minimum spacing in order to be able to perform the reciprocating stroke movements thereof. In addition the smaller spacings between the stations IV through VI afford the above-mentioned advantage that in all three stations drying of the printing ink on the printed bottles takes place in a suitable fashion.

Figure 5:
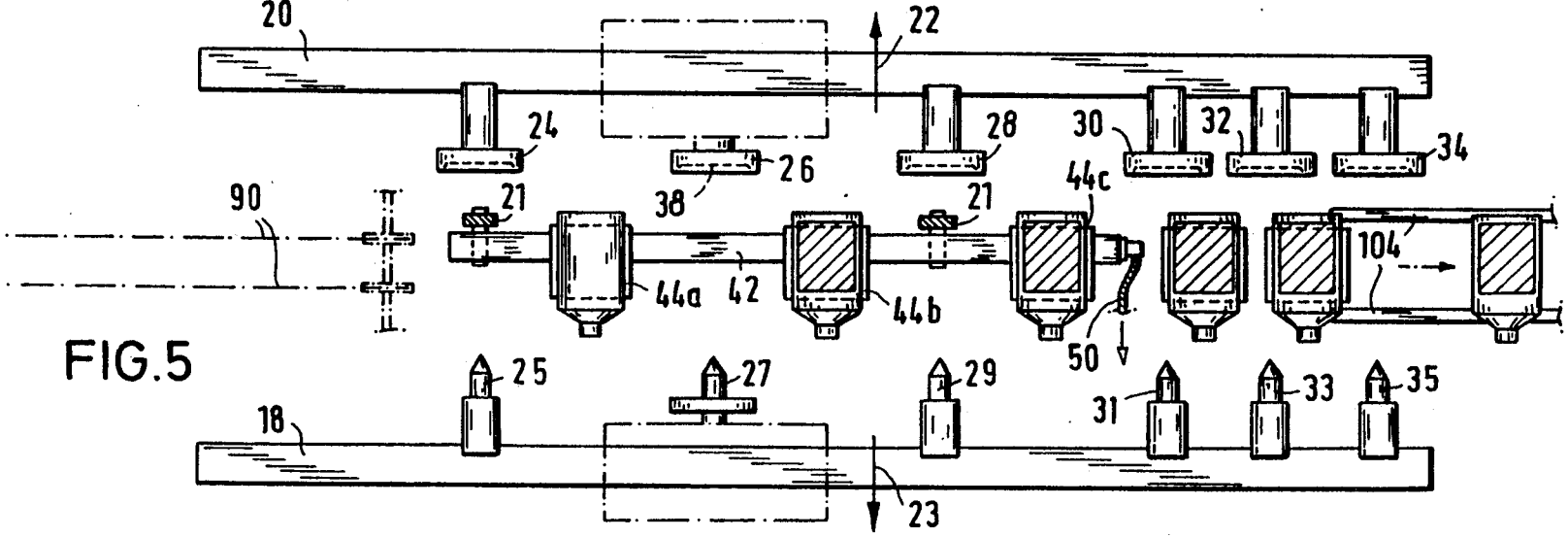
FIG. 5 is a plan view corresponding to that shown in FIG. 4.

Disposed downstream of the station VI is a guide path or track 104 on to which the bottle from the station VI drops after it has been released from the holding members 34 and 35 by virtue of the two rail members 18 and 20 moving away from each other in the directions indicated by the arrows 22 and 23 in FIG. 5.

In the illustrated embodiment of the apparatus, no treatment is performed in station III. That however is not absolutely necessary. It is at any event possible to provide additional stations, as a departure from the apparatus configuration shown in the drawings. Thus, it is possible to provide two or more printing stations if the article such as a bottle is to be provided with a multi-colour printed image thereon, while additional drying stations may possible be provided between the respective printing stations.

After termination of the various treatment operations in the individual stations, the respective bottles 15 disposed in each thereof are released by the first and second rail members 18 and 20 being moved away from each other as indicated by the arrows 22 and 23 in FIG. 5, after the transportation arrangements 12 and 100 had been previously pivoted into a position as shown in FIGS. 1 through 3. In that situation, the transportation holder **44*a* in station I is disposed directly beneath the bottle in that station, in a condition of bearing against the body thereof to support same, the transportation holder 44b is in a corresponding position beneath the bottle in printing station II and the transportation holder 44c is in a corresponding position in station III. After release of the respective bottles in stations I, II and III, by virtue of the rail members 18 and 20 moving away from each other, the bottles are then supported by the respective transportation holders 44a, 44b and 44c. They are securely held in position on their respective transportation holders by the above-discussed effect of a suction force applied thereto. Furthermore, if necessary, additional retaining elements may be provided on the transportation holders in order to secure the bottles in position during the transportation stepping movement of the assembly. A similar consideration applies in regard to the bottles in stations IV through VI, and the transportation arrangement 100**.

Figure 4:
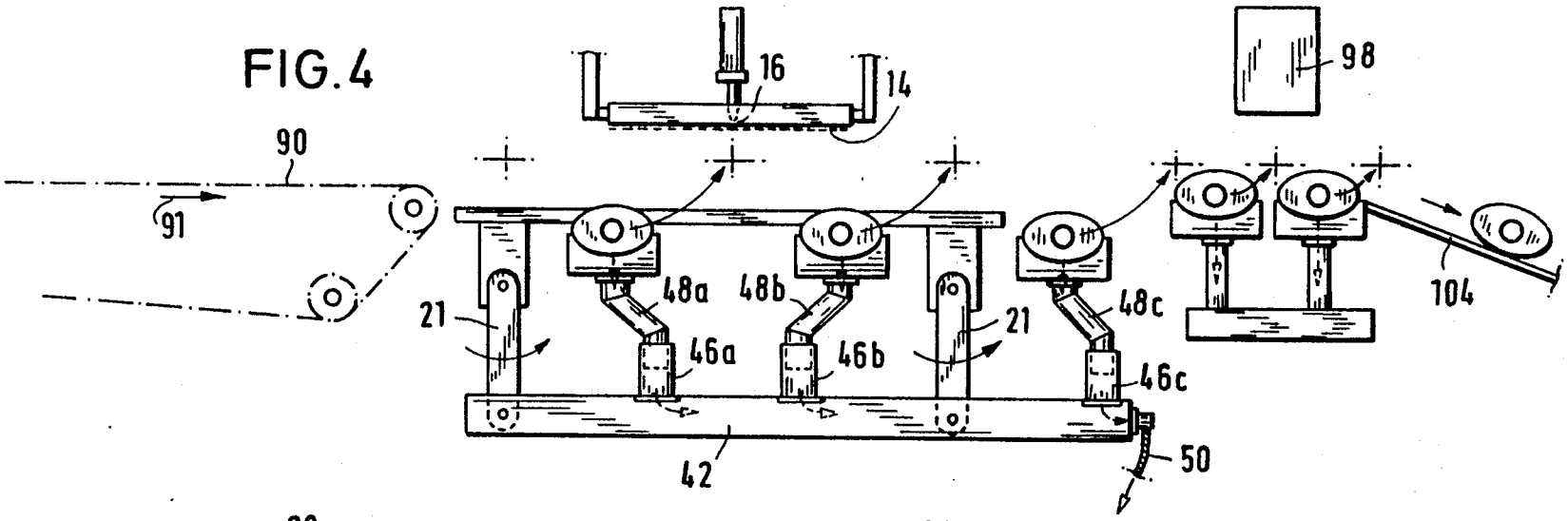
FIG. 4 is a view corresponding to that shown in FIG. 2 but in which the transportation holding members for the articles are in a different position from that shown in FIG. 2.

After the rail members 18 and 22 have been moved away from each other, the transportation arrangements 12 and 100 are pivoted in the direction indicated by the arrows 40 in FIG. 2. FIGS 4 and 5 show the central position during that pivotal movement.

At the end of that pivotal movement, that is to say in a second limit position of the transportation arrangements 12 and 100, the transportation holder 44a is in station II, more particularly once again at a position in which the bottle supported by the transportation holder 44a is aligned with the two holder members 26 and 27 at printing station II, which in the meantime occupy the position shown in FIG. 1.

In a corresponding manner the bottle supported by the transportation holder 44b, to which printing had previously been applied at the printing station II passes into station III where, in the course of the following movement of the rail members 18 and 20 towards each other in the directions indicated by the arrows 22 and 23 in FIG. 3, the bottle is received by the holding members 28 and 29. The bottle which had been previously positioned in station III is moved into station IV in the course of the pivotal movement of the transportation arrangement 12, and so forth in relation to the other stations and bottles associated therewith.

During the return stroke movement of the screen printing stencil 14 into its initial position for the next printing stroke movement thereof, the holding members 26 and 27 in the printing station II move therewith in an empty condition as the segments 52 (see for example FIG. 6) carrying them remain fixedly connected to the central drive which also drives the slider 88. In the printing station, when there are two holding members 26 and 27 which jointly form the holding arrangement for holding the respective article, it will generally be advantageous for a cam disc or plate 80 and a slider to be associated with each holding member, with both sliders 88 being connected by a transverse member for transmitting the drive from one slider 88 to the other. The process and apparatus as described above in accordance with the teachings of the invention have the advantage that, with the articles being of a given cross-sectional configuration, the center points or center lines thereof are disposed in the same plane in all the stations of the apparatus, that consideration applying, in relation to those stations in which the holding members are arranged to be pivotable, in respect of the position in which the articles are received by and removed from the respective holding arrangement.

Adaptation of the apparatus to articles of different dimensions is effected by suitable adjustment of the position in respect of height of the toothed segment 52, the segment diameter, the diameter of the gear 64 and possibly also the gears which are disposed upstream of the latter, wherein the variations in position which arise as a result of varying diameters of the toothed segment 52 and the gear 64 can be produced by suitable pivotal movement of the arm 96 shown in FIG. 6.

When changing from one kind of article to another which is of different dimension, the following adjusting steps are required in each case:

1. When the surface of the article to which printing is to be applied is of the same radius but the article is of a different dimension transversely with respect to the longer axis of the non-round cross-sectional configuration, the screen printing stencil is to be suitably adjusted in regard to its position in respect of height.

2. When the article is of the same dimension transversely with respect to the longer axis of for example an elliptical cross-sectional configuration but when the radius of curvature of the surface to be printed upon is different, the apparatus is to use a toothed segment or gear 52 which is suitably adapted thereto and which possibly has to be adjusted in respect of its height by suitable positioning on the rail 56.

3. In the event of variations in the dimension transverse to the longer axis of the cross-sectional configuration and with a simultaneous change in the curvature of the surface to which printing is to be applied, both the adjusting operations set forth above in paragraphs 1 and 2 are to be carried out.

In addition, in the event of a change in the dimension of the article normal to the loner axis of the cross-sectional configuration thereof, it is necessary to adapt the position of the transportation holders 44a, 44b, 44c and 102a, 102b to the respective requirements involved by using tubular intermediate members 46a, 46b and 46c of suitable dimensions. That consideration also applies, in regard to the cross-sectional shape and in particular in relation to the radius of the surface of the respective article 15 which bears against the respective transportation holders, in relation to the transportation holders 44a, 44b, 44c, 102a, 102b themselves, wherein the respective surface thereof for supporting the article must be suitably matched to the cross-sectional shape of the article.

In a departure from the illustrated embodiment, it is also possible for the holding arrangement to be of a one-piece configuration. That is the case for example when printing is to be applied to articles which have a large mouth opening, for example buckets, in which the single holding member is in the form of a core member which is introduced into the bucket to support it during the printing operation.

The frame structure (not shown) which carries the screen printing stencil 14 is also mounted to be adjustable in respect of height in order to be able to adapt the position of the screen printing stencil to articles of different cross-sectional dimensions. Adjustment of the screen printing stencil frame in respect of height during a working cycle is generally not necessary as the resilient deformability of the stencil is sufficient to bring it into contact with the article to which printing is to be applied, by virtue of the pressure applied to the article by the squeegee 16. When the squeegee 16 is lifted off the article, for example into the position shown in FIG. 2, the screen printing stencil 14 then also lifts away from the article.

Figure 10:
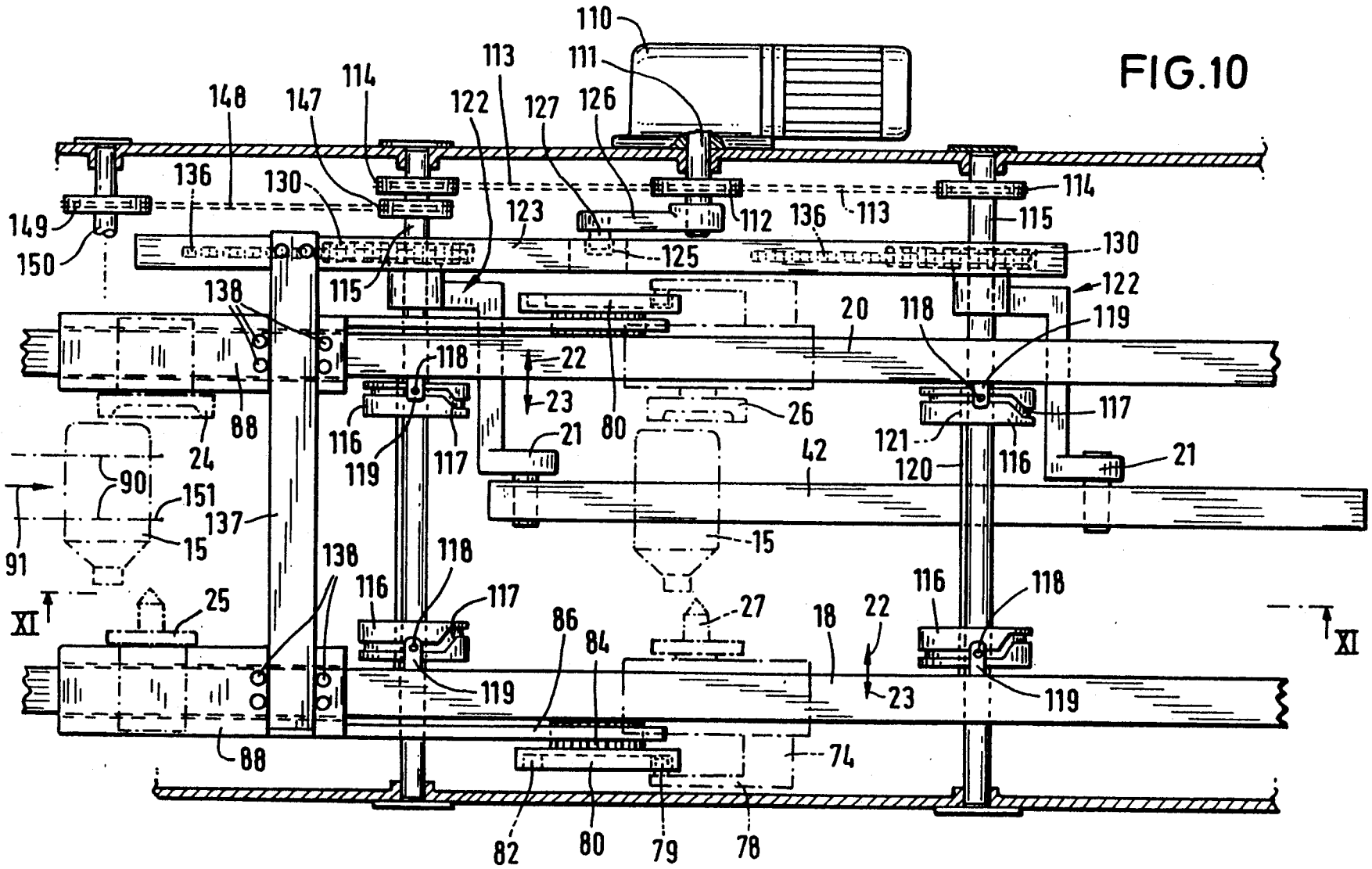
FIG. 10 is a plan view of the FIG. 3 structure, showing only the individual drive elements.
Figure 11:
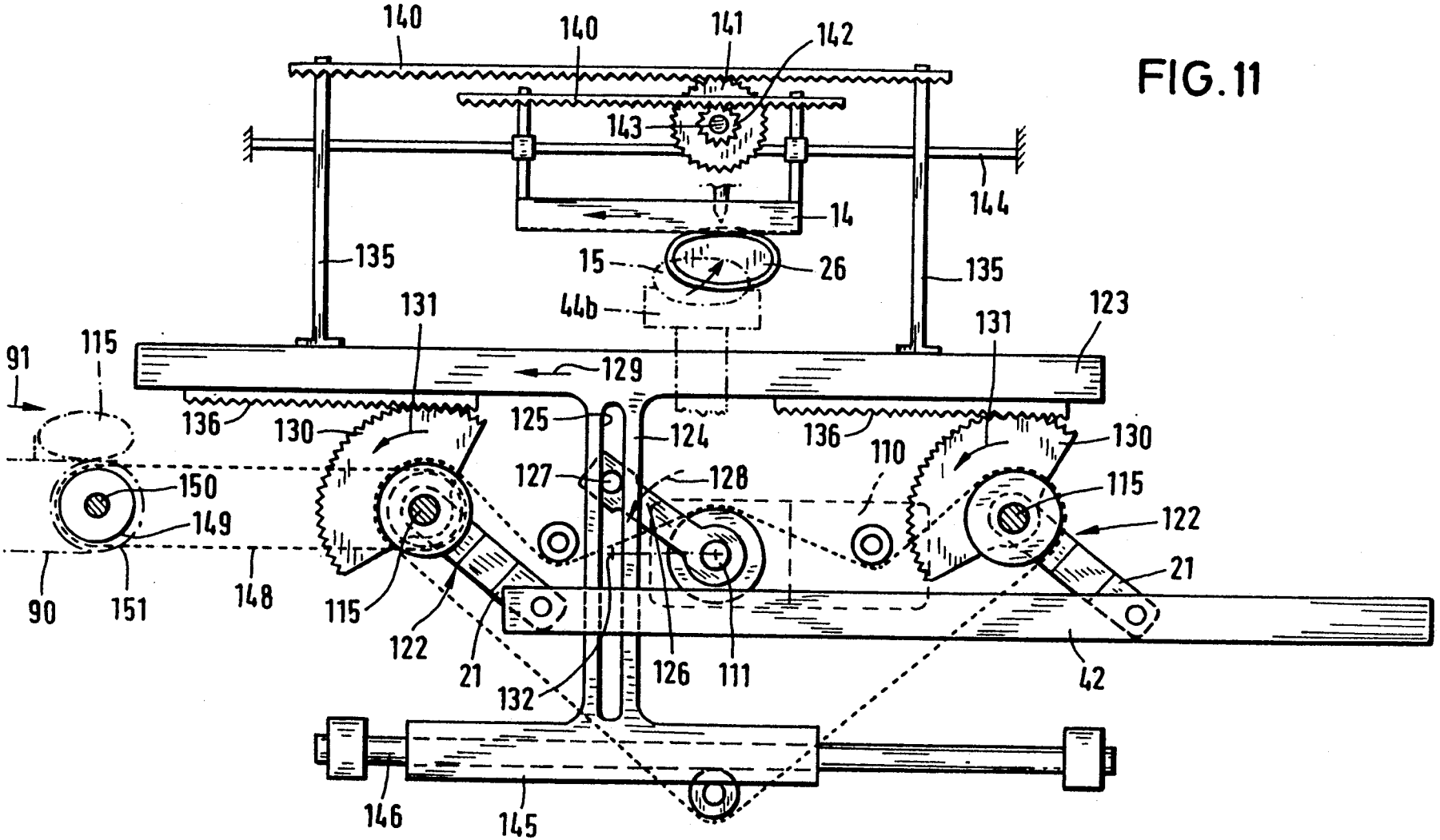
FIG. 11 is a view in section taken along line XI—XI in FIG. 10 but with omission of the drives for the rail members indicated at 18 and 20 therein.

Reference will now be made to FIGS. 10 and 11 illustrating further details of the structure of the apparatus according to the invention. It will thus be noted that, in order for the above-described screen printing apparatus to operate in a condition of absolute synchronism, all the movements of the components of the apparatus are produced by a single drive motor indicated at 110 in FIG. 10. Carried on the main drive shaft 111 of the drive motor 110 is a chain wheel 112 which drives by way of a chain 113 chain wheels 114 and therewith shafts 115. Cam plates or discs 116 are carried on the shafts 115 non-rotatably but slidably thereon, by means of ribs 120 and grooves 121. Pins 118 engage into cam tracks 117 on the respective cam discs or plates 116, the pins displacing the rail members 18 and 20 in the directions indicated by the arrows 22 and 23 in FIG. 3, by way of control bars 119.

The holding members 24 through 35 of the individual stations I through VI are opened and closed by means of the movements of the rail members 18 and 20, in the above-discussed fashion.

Looking still at FIG. 10, members indicated at 122 in FIGS. 10 and 11 are freely rotatably arranged on the shafts 115 which are disposed at stationary locations relative to the frame structure of the apparatus. At one end each of the members 122 carries a toothed segment 130 while at the other end it carries a respective pivotal arm 21 to which the bearer 42 with the transportation holders **44*a*–44*c* is mounted, in the manner described above with reference for example to FIG. 1. The pivotal arms 21 are driven by way of a double-T-shaped frame structure indicated at 123 in FIG. 11**.

Disposed in the central web portion 124 of the frame structure 123 is a sliding guide in the form of a slot 125 into which engages a sliding member 127 which is carried on a lever 126 on the main drive shaft 111. When the lever 126 is rotated in the direction indicated by the arrow 128 in FIG. 11, the sliding member 127 moves downwardly and slides the frame structure 123 towards the left in FIG. 11 in the direction indicated by the arrow 129.

The toothed segment 130 on the member 122 also rotates somewhat in the direction indicated by the arrow 131, driven by the toothed rack 136. The bearer 42 is also pivoted somewhat upwardly by way of the pivotal arms 21. When the sliding member 127 has reached the dead point position indicated at 132, the transportation holder **44*b* with its article 15 is disposed in the printing position between the screen printing stencil 14. The holding members 26 and 27 now receive the article 15** to support same.

When the sliding member 127 has moved beyond the dead point position 132, the entire arrangement rotates and moves back in the opposite direction.

Secured to the frame structure 123 at the left-part thereof in FIGS. 10 and 11 is an entrainment arm indicated 137 in FIG. 10, which moves the drive sliders 88 towards the right and towards the left, in the above-discussed manner. In that arrangement rollers 138 permit a relative movement between the drive sliders with the rail members 18 and 20, relative to the entrainment arm 137, in the directions indicated by the arrows 22 and 23 in FIG. 3. Arranged on the upper part of the frame structure 123 are holders 135 for toothed racks 140 for driving the screen printing stencil 14. A gear 141 with coupled pinion 142 converts the travel of the toothed rack 140 to the travel distance which is required for producing the printing on the article 15.

The shaft 143 on which the gear 141 and the pinion 142 are disposed is mounted at a stationary location in the frame structure of the apparatus.

Reference numeral 144 in FIG. 11 identifies guide bars or rods for guiding the screen printing stencil 14. The frame structure 123 is mounted slidably in relation to the fixed frame structure of the apparatus by way of a guide assembly indicated at 145 with guide bar or rod 146.

The articles 15 are transferred into the illustrated apparatus by way of a conveyor belt 90 which has been referred to above and which is also driven by way of the shaft 111. The drive is from the shaft 115 shown at the left in FIG. 11, by way of the chain wheel 147, the chain 148, the chain 149, to the shaft 150, and from there to the guide roller 151 of the conveyor belt assembly 90.

It will be appreciated that the above-described process and apparatus structure have been set forth solely by way of example and illustration of the principles of the present invention and that various modifications and alterations may be made therein without thereby departing from the spirit and scope of the invention.

What is claimed is:

1. A screen printing process for printing on at least one portion of an article, which portion has a non-circular cross-section such that said portion has two mutually-perpendicular cross-sectional axes, one being longer than the other, said axes intersecting at a center point of said portion, comprising the steps of (a) mounting said article at a printing station in printing relationship with screen printing means such that said article is rotatable about a rotational axis perpendicular to said cross-sectional axes and displaced from said center point of said portion, (b) placing said article into a first position in space at the printing station in which the longer cross-sectional axis of said portion is substantially horizontal, (c) rotating said article at the printing station in a first angular direction from said first position to a second position, (d) rotating said article at the printing station in a second angular direction opposite to said first angular direction from said second position past said first position to a third position while simultaneously printing on said article during at least a portion of rotation of said article from said second position to said third position, and (e) rotating said article at the printing station in said first angular direction from said third position back to said first position in space.

2. A process as in claim 1, wherein said second and third position are spaced at equal angular distances from said first position.

3. A process as in claim 1, wherein steps (a) through (e) are performed in immediate succession.

4. A screen printing apparatus for printing on at least one portion of an article, which portion has a curved non-circular cross-section such that said portions has two mutually-perpendicular cross-sectional axes, one being longer than the other, said axes intersecting at a center point of said portion, comprising (a) a screen printing stencil, (b) a squeegee displaceable with respect to said screen printing stencil, (c) mounting means for mounting said article at a printing station in printing relationship with said screen printing stencil, said mounting means and said article being rotatable at the printing station about a substantially horizontal rotational axis perpendicular to said cross-sectional axes and displaced from said center point of said portion, said mounting means having a first position in space in which said article is in a first position in space in which the longer cross-sectional axis of said portion is substantially horizontal, (d) drive means engaging said mounting means for sequentially rotating said mounting means and said article at the printing station in a first angular direction from said first position to a second position in a second angular direction opposite to said first angular direction from said second position past said first position to a third position, and in said first angular direction from said third position back to said first position in space, and (e) means for engaging said printing stencil with said portion for printing thereon during at least a portion of rotation of said mounting means and said article from said second position to said third position.

5. Apparatus as in claim 4, wherein said first position is disposed substantially midway between said second and third positions.

6. Apparatus as in claim 4, including means for displacing the rotational axis relative to said printing stencil for adapting said apparatus to articles of differing configurations.

7. Apparatus as in claim 4, wherein said mounting means comprises first and second holding members spaced apart from each other and disposed in mutually opposite relationship and being pivotable synchronously with each other, and means for moving said holding members toward and away from each other to vary the spacing between said members.

8. Apparatus as in claim 4, further comprising circular toothed gear means on said mounting means, said gear means having a pitch circle of preselected curvature corresponding to the curvature of said curved non-circular portion of said article, a portion of said pitch circle being in alignment with said curved non-circular portion.

9. Apparatus as in claim 8, wherein said gear means comprises a toothed segment.

10. Apparatus as in claim 8, further comprising cam means and am follower means cooperating with said cam means and connected to said gear means for transmitting a reciprocating movement to said gear means for driving said mounting means.

11. Apparatus as in claim 10, wherein the cam means comprises a cam disc with a cam element extending therearound.

12. Apparatus as in claim 10, further comprising a toothed rack driven by said cam means, a gear meshing with said gear means, and transmission means coupling said toothed rack and said gear.

13. Apparatus as in claim 12, wherein the gear means and at least the gear meshing with said gear means are interchangeable for adapting said apparatus to articles of differing configurations.

14. Apparatus as in claim 12, further comprising an adjustable carrier means for carrying at least the gear meshing with said gear means.

15. Apparatus as in claim 12, further comprising a second toothed rack for driving said cam means, and coupling means for coupling said second rack to a central machine drive of said apparatus.

16. Apparatus as in claim 4, further comprising a plurality of operating stations at which articles are mounted in said mounting means and a reciprocatable transportation means for stepwise transportation of said articles from one operating station to another, said transportation means being disposed substantially beneath said operating stations and including article holding means on said transportation means at spacings from each other corresponding to the spacings between the operating stations.

17. Apparatus as in claim 16, wherein the article holding means are vertically displaceable for permitting adjustment in respect of height.

18. Apparatus as in claim 16, further comprising a carrier beam and intermediate members supported on said carrier beam for carrying said article holding means of said transportation means.

19. Apparatus as in claim 18, wherein said article holding means are interchangeable for adapting said article holding means to articles of differing configurations.

20. Apparatus as in claim 19, wherein said article holding means have an article supporting surface for supporting an article to be transported by said transportation means, said surface having at least one opening therein, said apparatus further comprising a suction source means and means connecting the suction source means to said at least opening.

* * * * *